US008920087B2

(12) United States Patent
Buder et al.

(10) Patent No.: US 8,920,087 B2
(45) Date of Patent: Dec. 30, 2014

(54) ADHESIVE PACKAGE AND USE THEREOF WITH AN ANCHORING ELEMENT

(75) Inventors: Astrid Buder, Kaufering (DE); Kolja Wieczorek, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 57 days.

(21) Appl. No.: 13/427,627

(22) Filed: Mar. 22, 2012

(65) Prior Publication Data

US 2012/0282059 A1 Nov. 8, 2012

(30) Foreign Application Priority Data

Mar. 23, 2011 (DE) ..... 10 2011 005 960

(51) Int. Cl.
*E21D 20/00* (2006.01)
*E21D 21/00* (2006.01)
*E21D 20/02* (2006.01)

(52) U.S. Cl.
CPC ..... *E21D 20/026* (2013.01); *E21D 21/0026* (2013.01)
USPC ..... 411/82.3; 405/259.6

(58) Field of Classification Search
USPC ..... 411/82.3; 405/259.6
See application file for complete search history.

(56) References Cited

U.S. PATENT DOCUMENTS

| | | | | |
|---|---|---|---|---|
| RE25,869 | E * | 10/1965 | Schuermann | 405/259.6 |
| 4,303,354 | A | 12/1981 | McDowell, Jr. | |
| 4,372,708 | A * | 2/1983 | Bower et al. | 405/259.6 |
| 4,497,403 | A * | 2/1985 | Rausch | 206/219 |
| 4,518,283 | A | 5/1985 | Gebauer et al. | |
| 4,651,875 | A * | 3/1987 | Lang et al. | 206/219 |
| 4,706,806 | A * | 11/1987 | Mauthe | 206/219 |
| 5,551,805 | A | 9/1996 | Arnold et al. | |
| 5,763,026 | A * | 6/1998 | Makino et al. | 428/34.4 |
| 7,775,745 | B2 * | 8/2010 | Simmons et al. | 405/259.6 |
| 2008/0219775 | A1 * | 9/2008 | Mercier-Langevin et al. | 405/259.6 |

FOREIGN PATENT DOCUMENTS

| | | | |
|---|---|---|---|
| DE | 42 31 161 | A1 | 3/1994 |
| DE | 42 33 429 | A1 | 4/1994 |
| DE | 43 04 620 | A1 | 8/1994 |
| DE | 10 2009 002 951 | A1 | 11/2010 |

OTHER PUBLICATIONS

German Search Report, dated Dec. 13, 2011, 6 pages total.

* cited by examiner

*Primary Examiner* — Flemming Saether
(74) *Attorney, Agent, or Firm* — Crowell & Moring LLP

(57) ABSTRACT

An adhesive package and use thereof with an anchoring element is disclosed. The adhesive package includes a tubular foil pouch for receiving a multi-component adhesive mass having at least one hardener component and one reactive resin component that is separate from the hardener component. The reactive resin component has at least one first compound and one second compound which harden at different rates and which are arranged in succession in the tubular foil pouch. The reactive resin component has an additional polymerizable compound which is arranged behind the second compound on an end of the foil pouch that is opposite from the first compound. The additional polymerizable compound hardens more slowly than the second compound and provides a leak protection for the second compound and/or the hardener component.

15 Claims, 3 Drawing Sheets

ADHESIVE PACKAGE AND USE THEREOF WITH AN ANCHORING ELEMENT

This application claims the priority of German Patent Document No. 10 2011 005 960.1, filed Mar. 23, 2011, the disclosure of which is expressly incorporated by reference herein.

BACKGROUND AND SUMMARY OF THE INVENTION

The invention relates to an adhesive package, especially for use with an anchoring element, having a tubular foil pouch for receiving a multi-component adhesive mass.

Fastening elements for chemical anchoring in a substrate are known from the prior art from U.S. Pat. No. 4,303,354, for example. In the case of this anchoring element, two foil pouches having masses that can harden at different rates are introduced into a drill hole that has been created prior to this, with the foil pouch facing the base of the drill hole containing a rapidly hardening compound and the subsequent foil pouch containing a compound that hardens comparatively slower. When introducing the fastening element, the pouch with the slower hardening compound is destroyed first and the components contained therein are mixed to form a first hardenable mass. Then the foil pouch with the rapidly hardening compound is destroyed and the components contained therein are mixed to form a second hardenable mass, wherein the components begin to harden immediately, while the first mass hardens with a time lag.

German Patent Document No. DE 10 2009 002 951 A1 shows a self-drilling rock anchor having a hollow cylindrical receiving body, which has a drill head on one end and in which an extrudable, multi-component mass is provided. The multi-component mass comprises at least one hardener component and at least one reactive resin component, which are kept separate from each other and harden in a mixed state. Passage openings for the multi-component mass are provided in the area of the drill head. The reactive resin component comprises two different compounds, which are arranged in succession, wherein the second compound of the reactive resin component, which hardens rapidly in the mixture with the hardener component, is arranged behind the first compound of the reactive resin component with respect to the drive-in direction of the fastening element, which first compound hardens more slowly in the mixture with the hardener component than the second compound.

The hardener component and the reactive resin component are normally accommodated in separate chambers of a tubular foil pouch. The foil pouches are sealed on their ends by means of metal wire or metal clips. Wires made of aluminum, iron or copper are typically used for this. However, the tying off and sealing of the foil pouches with metal wire or metal clips does not represent an absolutely tight seal, because the squeezing of the different foil layers by the metal wire or metal clip may lead to the formation of minute capillary channels in the sealing section of the foil pouch. In addition, the foil skin of the foil pouch may be injured and damaged by compressing the metal wire. In the case of thin foils, granular filler materials contained in the adhesive mass may also injure the foil skin.

Because of the capillary channels, which form in the sealing section of the foil pouch, the thin fluid constituents of the adhesive mass in particular may continuously escape. The thin fluid constituents may be in particular the phlegmatizing agent of the hardener component, e.g., water, and the reactive diluent or hardening accelerator of the reactive resin component, e.g., styrene or N,N-dimethylaniline. The continuous outflow of these fluid constituents during storage of the foil pouch, however, may produce a disequilibrium in the overall formulation in the application and in the worst case negatively impact and/or delay the hardening of the adhesive masses.

The change in volume associated with the escape of the liquid components during storage may likewise have a negative impact on the functional use of the foil pouch. In the case of conventional anchoring systems, a slackened foil pouch may lead, for example, to the anchor rod that is inserted while rotating not cutting the foil pouch in a reproducible manner. In the case of a self-drilling anchoring element, the chamber in which the reactive resin component is stored may squeeze the chamber for the hardener component and thereby interfere with the uniform extrusion of the hardener component.

Therefore, the object of the invention is providing an adhesive package that may be used reliably in chemically anchored fastening elements even after longer storage periods and with consistent functionality.

The subject matter of the invention is also the use of the adhesive package according to the invention with an anchoring element.

Therefore, the invention provides an adhesive package, in which several reactive resin compounds that are hardenable at different rates are preferably contained in a continuous chamber of a foil pouch that is sealed on both ends. After completely emptying the foil pouch and mixing the hardener component with the reactive resin component, at least two masses that harden at differently rates are present. The first mass introduced into the drill hole advantageously hardens at a moderate speed so as not to block the flowing in of the second mass by premature gelling or hardening. The second mass flowing out after the first mass preferably hardens immediately in order to guarantee an initial strength of the connection between the anchoring element and the surrounding rocks.

The additional polymerizable compound that is filled in the foil pouch last and is therefore arranged behind the second compound does not assume any speed-determining function for hardening in the application case. However, during the storage period it provides a leak protection for the normally low viscosity second reactive resin compound.

The proportion of the additional polymerizable compound in the total quantity of adhesive mass is therefore preferably established with respect to the function as a leak protection. As a result, a considerably smaller quantity of the additional polymerizable compound may be present as compared to the first and second compounds.

The invention makes it possible to use highly reactive adhesive masses which normally contain reactive diluents based on (meth)acrylates. Because these compounds are normally present as liquids at normal use temperatures of 0 to 35° C., a considerably improved storage stability and consistent functionality may be achieved with the adhesive package according to the invention.

Furthermore, the adhesive package according to the invention makes a rapid setting time of prestressable and non-prestressable anchoring elements possible independent of the ambient temperature of the rock, because both a rapidly hardening mass that is advantageous for cold rock and a slowly hardening adhesive mass that is advantageous for use with warmer rocks are present.

According to a first embodiment, the same formulations may be used for the first compound and the additional polymerizable compound. This facilitates production of the adhesive package, because no additional resin components have to be provided.

If different formulations are used for the first compound and the additional polymerizable compound, the additional compound may be adapted optimally to the function as leak protection, e.g., by adjusting a high viscosity or by the use of components with which the capillaries in the sealing section of the foil pouch may be blocked.

The hardener component of the adhesive package according to the invention preferably contains a peroxide, preferably dibenzoyl peroxide. Examples of additional peroxides are cumol hydroperoxide, di-tert-butyl peroxide and potassium peroxodisulfate.

Compounds with at least one olefinic unsaturated base resin, a reactive diluent and a hardening accelerator are preferably used as the reactive resin compound. Reactive resins for use in adhesive masses for chemical anchoring fastening elements are known as a rule and disclosed, for example, in German Patent Document No. DE A 42 31 161 or U.S. Pat. No. 4,518,283.

Examples of the base resin are vinyl ester resins, in particular monomer mixtures and oligomer mixtures of esters of acrylic acids and methacrylic acids, which are generally designated as mono-, di-, tri- or poly(meth)acrylates. Especially preferred are vinyl ester resins on the basis of epoxy(meth) acrylate, urethane(meth)acrylate, urea(meth)acrylate, urethane/urea(meth)acrylate, ethoxylated bisphenol-A-di-(meth)acrylate and alkyl(meth)acrylates with or without hydroxyl substituents as well as mixtures thereof. Furthermore, unsaturated polyester resins may also be used.

The reactive diluent preferably includes compounds which are selected from the group made up of alkyl(meth)acrylate, hydroxy alkyl(meth)acrylate, in particular hydroxypropyl (meth)acrylate and hydroxyethyl(meth)acrylate, styrene and styrene derivatives such as divinylbenzene and alkyl styrene, in particular α-methylstyrene, vinyltoluene and tert-butyl styrene, as well as ethylene glycol di(meth)acrylate and butandiol di(meth)acrylate. Styrene and butandiol di(meth) acrylate are preferred.

Examples of suitable hardening accelerators are tertiary amines such as triethylamine, dialkylarylamines such as N,N-dimethyl-p-toluidine and N,N-dimethylaniline, hidden amines in the form of imines such as the imine of aniline and butanal, and dihydropyridine derivatives such as 3,5-diethyl-1,2-dihydro-1-phenyl-2-propylpyridine, also in mixtures with one another. In addition, metallic salts such as Cu-, Co-, Mn-, Sn- and Ce-salts, e.g., copper octanoate or cobalt octanoate, may be used as the hardening accelerator, which catalyze the disintegration of peroxides.

In addition, both the reactive resin component as well as the hardener component may also contain one or more additional additives. Softening agents, non-reactive diluents or flexibilizers, e.g., solvents, stabilizers, rheology additives, thixotropic agents, wetting agents, coloring additives, dispersing agents, emulsifiers, antioxidants, light stabilizers, UV stabilizers or IR stabilizers, flame retardants, bonding agents and leveling agents may be contained as additional additives. These types of additional additives may be present in proportions totaling 0 to 50% by weight, preferably 0.01 to 20% by weight, related to the total weight of the adhesive mass.

Filler materials may also be present where necessary in one or more of the components. Examples of common filler materials are chalk, quartz, polymer powder, glass spheres and hollow glass spheres, corundum, talc, which may be added as powder, granulate or in the form of molded bodies, also in mixtures with one another. The proportion of filler materials may be, for example, from 0 to 80% by weight, preferably up to 50%, related to the total weight of the adhesive mass.

A person skilled in the art knows how to formulate masses that harden more rapidly or more slowly from the cited constituents for the hardener component and the reactive resin component. For example, reactive diluents with a (meth) acrylate base, especially butandiol(meth)acrylate, as well as base resins based on vinyl esters are preferred for the more rapidly hardening part of the adhesive mass with the second compound in the reactive resin component.

In addition, the hardening time of the respective part of the adhesive mass may be influenced by the proportion of hardening accelerator, wherein the second compound in the rapidly hardening part of the mass preferably contains proportions of hardening accelerator of 2 to 30% by weight, related to the proportions of base resin and reactive diluent in the second compound.

The first compound in the part of the adhesive mass that hardens more slowly preferably contains a styrene derivative as the reactive diluent, especially preferably styrene. The base resin is preferably an unsaturated polyester resin, a vinyl ester resin and/or a urethane(meth)acrylate resin. The proportion of hardening accelerator in the first compound is preferably from 0 to 30% by weight, related to the weight of base resin and reactive diluent in the first compound.

The hardening time of the first part of the adhesive mass, after adding the hardener component to the first compound, is preferably approx. 0.5 to 10 minutes, especially preferably 1 to 10 minutes. The hardening time of the second, rapidly hardening part of the adhesive mass formed by mixing the second compound with the hardener component is preferably in the range of 1 to 30 seconds.

According to a preferred embodiment, the weight ratio of the reactive resin component to the hardener component is approx. 1:1 to 10:1, preferably 3:1 to 5:1.

The weight ratio of the first compound and the second compound in the reactive resin component is preferably approx. 2:1 to approx. 1:2. Especially preferably the two compounds are present in the reactive resin component in about the same proportions.

The additional polymerizable compound of the reactive resin component provided at the end of the foil pouch as leak protection contains, like the first compound, preferably a derivative as the reactive diluent, especially preferably styrene, preferably in a proportion of 0.05 to 70% by weight, related to the total weight of the base resin and reactive diluent in the additional compound.

The base resin is preferably an unsaturated polyester resin, a vinyl ester resin and/or a urethane(meth)acrylate resin and is preferably present in a proportion of 30 to 99.95% by weight, related to the total weight of the base resin and reactive diluent in the additional compound.

The proportion of hardening accelerator in the additional compound is preferably from 0 to 30% by weight, related to the weight of the base resin and reactive diluent in the additional compound.

Essentially the same formulations may be used for the first compound and the additional polymerizable compound, wherein the rheological properties of the additional compound may be adjusted where applicable with the use of additional additives such as binding agents or thixotropic agents according to their function as leak protection.

According to a preferred embodiment of the adhesive package according to the invention, the additional polymerizable compound provided as leak protection at the end of the foil pouch in the reactive resin component is present in a volume fraction of 2 to 30 percent, related to the total volume of the hardener component and reactive resin components. The precise quantity of the additional polymerizable compound will be established by a person skilled in the art based on the geometry of the adhesive package and the rheological properties of the second compound. For example, wider foil pouches as well as low viscosity adjustments of the rapidly hardening second compound require a great quantity of the additional compound.

In general, the additional polymerizable compound is used in so small a quantity that the function of the rapidly hardening part of the adhesive mass is not impacted negatively in terms of providing an adequate initial strength.

According to another embodiment, as an alternative or in addition to the embodiments described above, the additional polymerizable compound may contain a non-porous solid dissolved in the compound and/or optionally in a solvent compatible with the compound. The solid contained in the compound and/or in the solvent is then drawn into the capillaries in the sealing section of the foil pouch and the capillaries are blocked after evaporation of the volatile components of the compound.

Moreover, it may be provided that the additional polymerizable compound contains an air-curing and/or moisture-curing component. After the compound exits from the sealing section of the foil pouch, the additional polymerizable compound hardens under ambient conditions and thereby likewise blocks the capillaries in the sealing section of the foil pouch.

The tubular foil pouch of the adhesive package according to the invention is advantageously formed of a multi-layer foil that is coordinated with the chemical properties of the components of the adhesive mass.

All components of the adhesive mass are preferably arranged in a common tubular foil pouch. The foil pouch is advantageously formed of a flat material, which is folded and appropriately fused to form the required number of chambers.

The hardener component and the reactive resin component of the adhesive mass are preferably arranged in separate chambers of the foil pouch.

According to a preferred embodiment, the hardener component and the reactive resin component are each arranged in a continuous chamber of the foil pouch, which extends from one end of the foil pouch to the other end thereof.

The separation of the different compounds of the reactive resin component is preferably accomplished by a suitable adjustment of their rheological properties, in particular by the selection of a base resin with suitable viscosity and adjusting the proportion of reactive diluent as well as optionally by adding additional additives such as thixotropic agents and binding agents. As a result, flow boundaries form between the compounds, which prevent the compounds from mixing when the adhesive package is being stored.

The adhesive package according to the invention is suitable preferably for use with a fastening element for chemical anchoring.

This anchoring element may be designed to be self-drilling or non-self-drilling.

In the case of a use with non-self-drilling anchoring elements, the adhesive package is introduced into a pre-made drill hole in such a way that the second compound points toward the base of the drill hole. Then the anchoring element is introduced into the drill hole and cuts the adhesive package so that the hardener component and the reactive resin component exit and provide at least two parts of the adhesive mass that harden at different rates.

The fastening element is especially preferably a self-drilling rock bolt, which can be designed as a passive anchor or an active anchor.

In the case of an active anchor, the fastening element that is already partially anchored in the substrate via the rapidly hardening part of the adhesive mass may be pre-stressed by a pre-stress element almost directly after the adhesive mass has been completely squeezed out. Because of the time-delayed subsequent hardening of the slowly or moderately reacting first part of the adhesive mass in the pre-stressed area, the pre-stressing of the fastening element is chemically fixed.

In the case of a passive anchor, the drilling motor and the extrusion unit may be removed immediately after completely extracting the adhesive mass and a subsequent fastening element may be placed, because directly after completely squeezing out the adhesive mass at least one partial anchoring of the fastening element is achieved.

The invention also relates therefore to a fastening element for chemical anchoring in a substrate, having a receiving body for an extrudable adhesive mass, wherein a drill head is provided on an end of the receiving body, and an adhesive package according to the invention is introduced into the receiving body, wherein the adhesive package is arranged in the receiving body in such a way that the first compound is adjacent to the drill head and the second compound is adjacent to an end of the fastening element that is opposite from the drill head.

After completely extruding the adhesive mass, at least two different rapidly hardening parts of the mass are present. The first part of the adhesive mass flowing out and formed by the mixing of the hardener component and the first compound hardens at a moderate speed and guarantees the subsequent flow of the second part of the adhesive mass, which is formed by the mixing of the hardener component and the second compound. The second part of the mass that flows out after the first part of the adhesive mass hardens more rapidly than the first part of the mass and immediately in an advantageous manner. This guarantees that the fastening element is rapidly and securely anchored in the substrate, wherein the rapidly hardening part of the adhesive mass comes to rest in the region of the base of the drill hole, thereby guaranteeing an advantageous application of force in the substrate.

Because of the different hardening times of the parts of the adhesive mass, the fastening elements according to the invention may be driven in independent of the temperature of the substrate, whereby the fastening element according to the invention may be used flexibly in particular in tunnel building or underground work. Normally, rapidly hardening masses are used in the case of cold substrates and slowly hardening masses in the case of hot or warm substrates. Because the fastening element according to the invention has at least two parts of the adhesive mass that harden at different rates, a secure anchoring of the fastening element in different substrates is guaranteed.

The invention will be explained in more detail in the following on the basis of an exemplary embodiment.

DETAILED DESCRIPTION OF THE DRAWINGS

As a rule, the same parts are provided with the same reference numbers in the figures.

Figure 1:
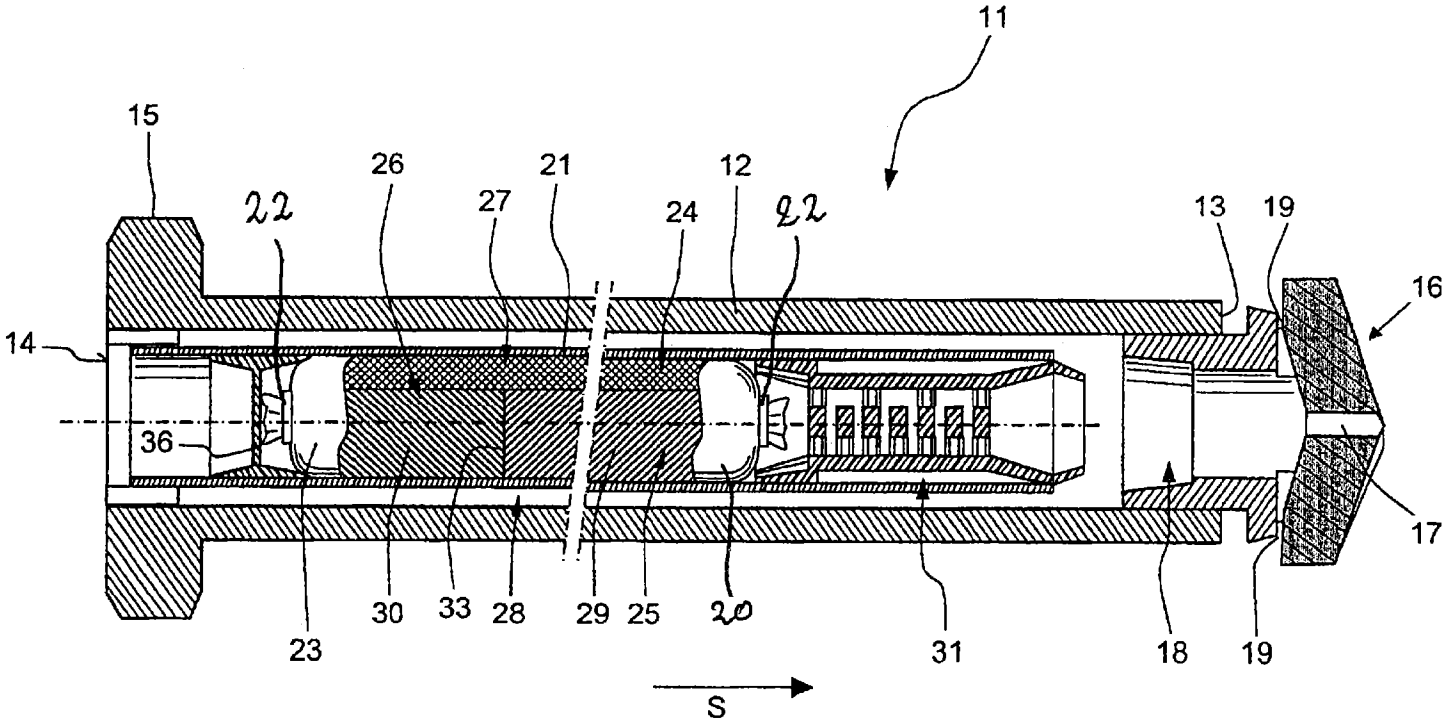
FIG. 1 is a schematic longitudinal section of a self-drilling fastening element in the form of a rock bolt.

The self-drilling fastening element 11 depicted in FIG. 1, in this case in the form of a rock bolt, has a hollow cylindrical receiving body 12, which has a drill head 16 on a first end 13 lying in a placement direction S and a rotary pick-up structure 15, for example in the form of a polygon, that can be coupled with a drilling device (not shown here), on the opposite end 14. The drill head 16 has a first central passage opening 17 as well as two further radial passage openings 19. In addition, a receptacle 18, which tapers towards the free end of the drill head 16 and is designed in a funnel-shaped manner, is provided in the drill head 16.

An inner tube 21 is provided in the receiving body 12, in which the adhesive package 20 according to the invention is arranged, in an embodiment. The adhesive package 20 according to the invention comprises a tubular foil pouch 23 for receiving a multi-component adhesive mass 26. The opposing ends of the foil pouch 23 are each tied off and sealed with a metal wire 22.

Figure 2:
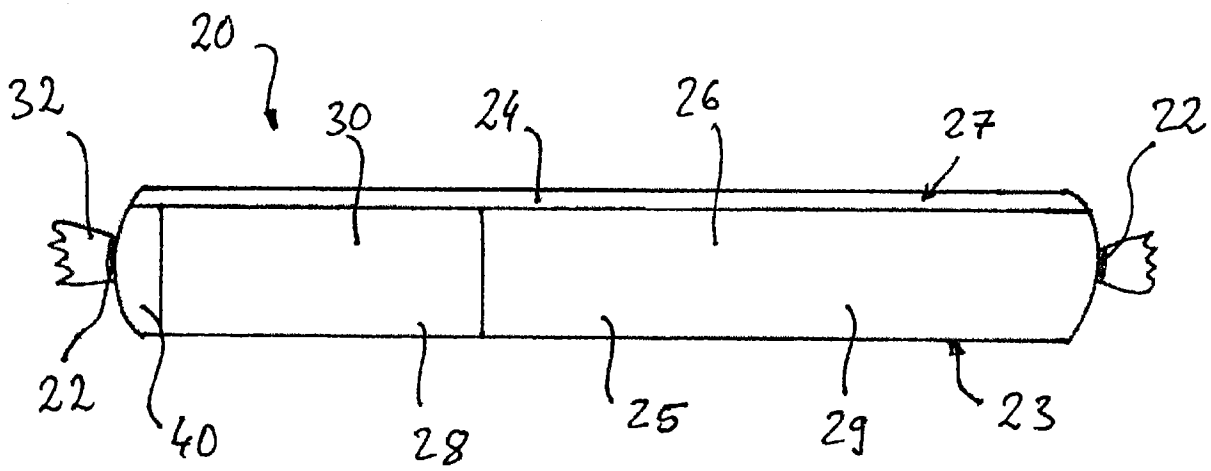
FIG. 2 is a detailed view of the adhesive package according to the invention.

As schematically shown in FIG. 2, the multi-component mass 26 of the adhesive package 20 comprises a reactive resin component 28 and a hardener component 27, which are stored in chambers that are separated from each other and which harden in a mixed state. The hardener component 27 is provided in a first chamber 24 of the foil pouch 23 running in the longitudinal direction of the foil pouch 23. The reactive resin component 28 is provided in a second chamber 25 of the foil pouch 23 running parallel to the first chamber 24 and comprises at least one first compound 29 as well as a second compound 30 that is different from the first compound 29.

The first compound 29 and the second compound 30 are arranged in succession in the continuous second chamber 25 of the foil pouch 23 that extends from one end to the other end of the foil pouch 23. A separating wall 33 that advantageously opens easily under pressure may be provided between the first compound 29 and the second compound 30. However, the rheological properties of the compounds 29, 30 are preferably adjusted such that stable flow boundaries that prevent mixing form in a stored state.

The second compound 30 of the reactive resin component 28 hardens in the mixture with the hardener component 27 more rapidly than the first compound 29.

Arranged behind the second compound 30 on an end 32 of the foil pouch 23 opposite from the first compound 29 is an additional polymerizable compound 40, which hardens more slowly than the second compound 30. The additional polymerizable compound 40 is adjusted in terms of its rheological properties such that a leak protection for the second compound 30 and/or the hardener component 27 is provided.

The first compound 29 and the additional polymerizable compound 40 may advantageously have the same formulation. By using additional additives like binding agents and thixotropic agents, the additional compound may be adapted optimally to its function as leak protection.

The hardener component 27 preferably contains a peroxide, preferably dibenzoyl peroxide.

Preferably compounds with at least one olefinic unsaturated base resin, a reactive diluent and a hardening accelerator are used as the reactive resin component 28.

Examples of the base resin are vinyl ester resins, urethane (meth)acrylate resins and unsaturated polyester resins.

The reactive diluent preferably includes compounds which are selected from the group made up of alkyl(meth)acrylate, hydroxy alkyl(meth)acrylate, styrene and styrene derivatives as well as ethylene glycol di(meth)acrylate and butandiol di(meth)acrylate. Styrene and butandiol di(meth)acrylate are preferred.

Examples of suitable hardening accelerators are tertiary amines such as triethylamine, dialkylarylamines such as N,N-dimethyl-p-toluidine and N,N-dimethylaniline, hidden amines in the form of imines such as the imine of aniline and butanal, and dihydropyridine derivatives, also in mixtures with one another. In addition, metallic salts such as Cu-, Co-, Mn-, Sn- and Ce-salts, e.g., copper octanoate or cobalt octanoate, may be used as the hardening accelerator, which catalyze the disintegration of peroxides.

In addition, both the reactive resin component as well as the hardener component may contain one or more additional additives and filler materials.

A reactive diluent with a (meth)acrylate base, especially butandiol methacrylate, is preferably used for the second compound 30 in the reactive resin component 28. The base resin is preferably a vinyl ester resin.

The first compound 29 and the additional polymerizable compound 40 preferably contain styrene or a styrene derivative as the reactive diluent, especially preferably styrene. The base resin is preferably an unsaturated polyester resin, a vinyl ester resin and/or a urethane(meth)acrylate resin.

Sample formulations of the first and the second compounds 29, 30 and the additional polymerizable compound 40 of the reactive resin component 28 as well as the hardener component 27 are indicated in the following. However, these examples are not conclusive. In fact, for the formulation of the adhesive mass, it is possible to fall back on the components and compounds described above and those also known from the prior art.

1. Hardener Component 27:
Dibenzoyl peroxide 20.0% by weight
Water 30.0% by weight
Quartz 0.01 to 0.03 mm 50.0% by weight
2. First Compound 29 and Polymerizable Compound 40:
Unsaturated polyester resin 27.0% by weight
Styrene 18.0% by weight
Dimethylaniline 0.1% by weight
Chalk 52.9% by weight
Pyrogenic silicic acid 2.0% by weight
3. Second Compound 30:
Bisphenol-A-diglyciclyl-dimethacrylate 25.0% by weight
1,4 butandiol dimethacrylate 20.0% by weight
Dimethylaniline 1.0% by weight
Chalk 51.5% by weight
Pyrogenic silicic acid 2.5% by weight The first compound 29 and the second compound 30 are present in the reactive resin component in weight percentages of 2:1 to 1:2. The mixing ratio of the reactive resin component 28 with the hardener component 27 is between approx. 5 and 3 parts by weight to 1 part by weight (5:1 to 3:1).

The proportion of the additional polymerizable compound 40 is selected in general such that the function of the second compound 30 is not negatively impacted in terms of providing an adequate initial strength of the adhesive mass.

In particular, the additional polymerizable compound in the reactive resin component 28 may be provided in a volume fraction of 2 to 30 percent, related to the total volume of the hardener component 27 and reactive resin component 28.

As further shown in FIG. 1, a mixing element 31 advantageously fabricated of plastic and positioned in a displaceable manner in the inner tube 21 is provided in the inner tube 21 between the adhesive mass 26 and the drill head 16. Provided on the end of the inner tube 21 opposite from the mixing element 31 is an extrusion plunger 36 in the inner tube 21 for squeezing out the adhesive mass 26. Because of the interspace between the inner tube 21 and the receiving body 12, suctioning off drill debris or drill dust or supplying rinse water to the drill head 16 is guaranteed.

The adhesive package 20 is inserted into the receiving body so that the second compound 30 is arranged behind the first compound 29 in placement direction S.

Figure 3:
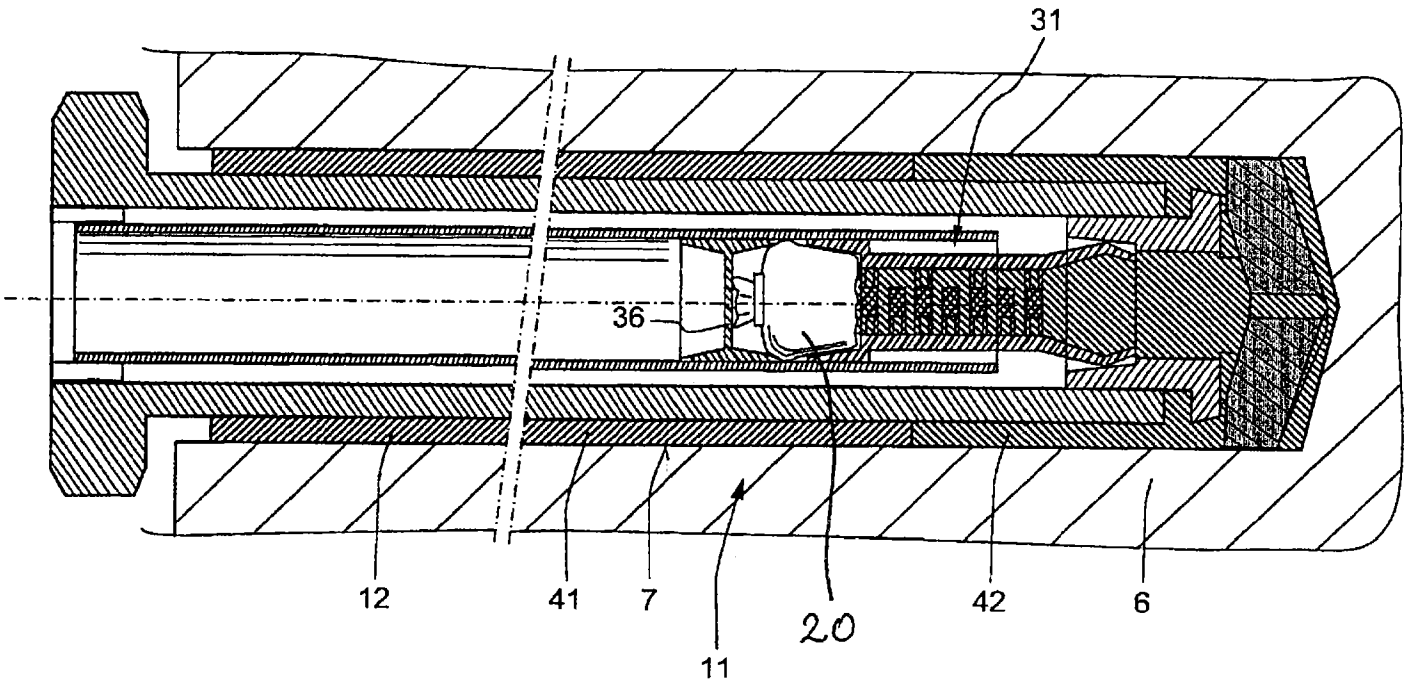
FIG. 3 is a view of the self-drilling fastening element in the driven-in state.

As shown in FIG. 3, the fastening element 11 is drilled as a whole into the substrate 6 using a drilling/extrusion unit (not shown here), which may be connected to the rotary pick-up structure 15 of the receiving body 12.

After reaching the desired drilling depth, pressure is applied via the extrusion unit to the extrusion plunger 36, e.g., by water, wherein first the mixing element 31 is pushed in the direction of the drill head 16 until the free end of the mixing element 31 comes to rest in the receptacle 18 of the drill head 16. With a further application of pressure to the extrusion plunger 36, the adhesive mass 26 flows out through the passage openings 17 and 19 in the drill head 16 out of the fastening element 11 while mixing the hardener component 27 and the reactive resin component 28.

The slowly hardening part of the mass 41 made of the hardener component 27 and the first compound 29 flows in this case first out of the fastening element 11 and fills the interspace between the outside wall of the receiving body 12 and the drill hole wall 7 of the base of the drill hole. The subsequently out-flowing second part of the mass 42 made of the hardener component 27 and the second compound 30, which hardens more rapidly, displaces the first part of the mass 41 further in the direction of the second end 14 of the receiving body 12. Because the second part of the mass 42 hardens rapidly in a few minutes, the fastening element 11 is anchored after extrusion of the adhesive mass 26 in the area of the base of the drill hole and sufficiently loadable. After the time-delayed hardening of the first part of the mass 41 the fastening element 11 is completely anchored in the substrate 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An adhesive package, comprising:
a tubular foil pouch; and
an adhesive mass disposed within the tubular foil pouch, wherein the adhesive mass comprises:
a hardener component; and
a reactive resin component that is separate from the hardener component, wherein the reactive resin component comprises a first compound, a second compound, and a polymerizable compound;
wherein the second compound hardens more rapidly than the first compound;
wherein the first compound and the second compound are disposed in succession in the tubular foil pouch;
wherein the polymerizable compound is disposed behind the second compound and adjacent to an end of the foil pouch that is opposite from the first compound;
wherein the polymerizable compound hardens more slowly than the second compound;
and wherein the first compound and the polymerizable compound are comprised of different compositions.

2. The adhesive package according to claim 1, wherein the polymerizable compound contains an olefinic unsaturated base resin, a reactive diluent, and a hardening accelerator.

3. The adhesive package according to claim 2, wherein the base resin is selected from the group consisting of unsaturated polyester resins, vinyl ester resins, and urethane (meth)acrylate resins as well as mixtures thereof.

4. The adhesive package according to claim 2, wherein the reactive diluent is selected from the group consisting of styrene and styrene derivatives.

5. The adhesive package according to claim 1, wherein the polymerizable compound contains a non-porous solid dissolved in the polymerizable compound and/or in a volatile solvent.

6. The adhesive package according to claim 1, wherein the polymerizable compound contains an air-curing and/or a moisture-curing component.

7. The adhesive package according to claim 1, wherein the hardener component and the reactive resin component are disposed in respective chambers of the tubular foil pouch that are separated from one another.

8. The adhesive package according to claim 1, wherein the second end of the tubular foil pouch has a sealing section, wherein the sealing section contains capillaries, and wherein the capillaries are blocked by the polymerizable compound.

9. An adhesive package, comprising:
a tubular foil pouch; and
an adhesive mass disposed within the tubular foil pouch, wherein the adhesive mass comprises:
a hardener component; and
a reactive resin component that is separate from the hardener component, wherein the reactive resin component comprises a first compound, a second compound, and a polymerizable compound;
wherein the second compound hardens more rapidly than the first compound;
wherein the first compound and the second compound are disposed in succession in the tubular foil pouch;
wherein the polymerizable compound is disposed behind the second compound and adjacent to an end of the foil pouch that is opposite from the first compound;
wherein the polymerizable compound hardens more slowly than the second compound;
and wherein the polymerizable compound is 2 to 30 percent by volume with respect to a total volume of the hardener component and reactive resin component.

10. A fastening element for chemical anchoring in a substrate, comprising:
a receiving body;
a drill head disposed on an end of the receiving body; and
an adhesive package disposed within the receiving body, wherein the adhesive package comprises:
a tubular foil pouch; and
an adhesive mass disposed within the tubular foil pouch, wherein the adhesive mass comprises:
a hardener component; and
a reactive resin component that is separate from the hardener component, wherein the reactive resin component comprises a first compound, a second compound, and a polymerizable compound;
wherein the second compound hardens more rapidly than the first compound;
wherein the first compound and the second compound are disposed in succession in the tubular foil pouch;

wherein the polymerizable compound is disposed behind the second compound and adjacent to an end of the foil pouch that is opposite from the first compound;

wherein the polymerizable compound hardens more slowly than the second compound;

and wherein the first compound is disposed adjacent to the drill head, the polymerizable compound is adjacent to an end of the receiving body that is opposite from the drill head, and wherein the second compound is disposed between the first compound and the polymerizable compound.

11. The fastening element according to claim 10, wherein the polymerizable compound contains an olefinic unsaturated base resin, a reactive diluent, and a hardening accelerator.

12. The fastening element according to claim 11, wherein the base resin is selected from the group consisting of unsaturated polyester resins, vinyl ester resins, and urethane (meth)acrylate resins as well as mixtures thereof.

13. The fastening element according to claim 10, wherein the polymerizable compound contains a non-porous solid dissolved in the polymerizable compound and/or in a volatile solvent.

14. The fastening element according to claim 10, wherein the polymerizable compound contains an air-curing and/or a moisture-curing component.

15. The fastening element according to claim 10, wherein the hardener component and the reactive resin component are disposed in respective chambers of the tubular foil pouch that are separated from one another.

* * * * *